United States Patent [19]

Keller

[11] 3,934,775

[45] Jan. 27, 1976

[54] WEB CENTERING DEVICE

[75] Inventor: William B. Keller, Bayside, N.Y.

[73] Assignee: Owens-Illinois, Inc., Toledo, Ohio

[22] Filed: Oct. 15, 1974

[21] Appl. No.: 514,477

[52] U.S. Cl. ..... 226/196; 74/241

[51] Int. Cl.[2] ..... B65H 23/04

[58] Field of Search ..... 226/21, 22, 23, 196, 197, 226/198, 199; 242/76; 74/241

[56] References Cited

UNITED STATES PATENTS

| | | | |
|---|---|---|---|
| 14,621 | 4/1856 | Wait | 74/241 |
| 893,690 | 7/1908 | Wood | 74/241 |
| 1,360,717 | 11/1920 | Bossert | 74/241 |
| 2,250,012 | 7/1941 | Eddy | 197/133 |
| 3,066,547 | 12/1962 | Evans et al. | 74/241 |
| 3,107,036 | 10/1963 | Richards et al. | 226/198 |
| 3,229,881 | 1/1966 | Eckhardt | 226/199 X |
| 3,265,272 | 8/1966 | Smith | 226/196 |

*Primary Examiner*—Allen N. Knowles
*Attorney, Agent, or Firm*—Thomas A. Meehan; Edward J. Holler

[57] ABSTRACT

Mechanical self-centering device to center a moving web of thin sheetlike material such as paper, plastic, metal or the like to prevent the web from drifting from side to side as it moves from one mechanical device, such as an unwind stand, to another mechanical device, such as a printing press, coating apparatus, a web splicer, a machine to fabricate finished products from the web such as a cup-making machine, or the like. The self-centering device comprises a roller extending transversely across the path of travel of the web and adapted to rotatingly contact the moving web on one side thereof. The roller is rotatingly mounted in a bracket which is free to pivot about an axis which is spaced from, and which extends generally parallel to, the path of travel of the web. Attached to the roller at points which are spaced apart by a distance slightly greater than the width of the web being processed are raised guides each of which is adapted to be contacted by an edge of the web as the web drifts to the side of the center of its intended path of travel. Such contact will cause the entire bracket to tilt about its axis in a plane extending transversely of the path of travel of the web, and this tilting action will tend to cause the web to return to the center of its path of travel.

3 Claims, 3 Drawing Figures

WEB CENTERING DEVICE

BACKGROUND OF THE INVENTION

The rapid processing of a web of sheetlike material frequently involves problems arising from improper tracking of the web as it moves from one processing station to another. In the case of a web originally furnished in the form of a roll or coil wound on a core, such problem can arise from out of square winding of the web on to the core. In commercial practice, edge guiding equipment can be purchased, but such equipment is usually powered and electrically controlled, and is, therefore, quite expensive.

GENERAL BACKGROUND OF THE INVENTION

In accordance with the present invention, however, the satisfactory self-centering of a longitudinally moving web of thin sheetlike material is accomplished by an unpowered and relatively simple mechanical device, without the need for electrical controls or the like. Such device comprises a roller freely rotatingly journalled at its opposed ends in a bracket, which roller extends transversely of the path of travel of the web and is adapted to rotatingly contact the moving web on one side thereof. The bracket in which the roller is journalled is free to pivot about an axis which is spaced from, and which extends generally parallel to, the path of travel of the web, the axis being closer to the side of the web which does not contact the roller than to the roller-contacting side of the web. Attached to the roller at points which are spaced apart by a distance slightly greater than the width of the web being processed are raised guides which, when the web is centered on its intended path of travel, are each spaced outwardly of an edge of the web by a minimum predetermined distance. The bracket in which the roller is journalled also includes a plate or equivalent structure disposed between the moving web and the axis about which the bracket pivots, to confine the path of travel of the web to the space defined by the roller and the raised guides.

If the center of the web drifts by more than a predetermined distance to one side or the other of the center of its intended path of travel, the edge of the web on the side to which it is drifting will contact the adjacent raised guide, and the force of the web on the guide will create a turning force on the bracket which will cause the bracket to tilt about its axis in a plane extending transversely of the path of travel of the web. Such tilting action will establish forces on the web which will tend to draw its center back toward the center of its intended path of travel.

Accordingly, it is an object of the present invention to provide mechanical self-centering apparatus for centering a moving web of thin sheetlike material along its intended path of travel.

For a further understanding of the present invention and the objects thereof, attention is directed to the drawing and the following description thereof, to the detailed description of the invention and to the appended claims.

DETAILED DESCRIPTION OF THE INVENTION

Figure 1:
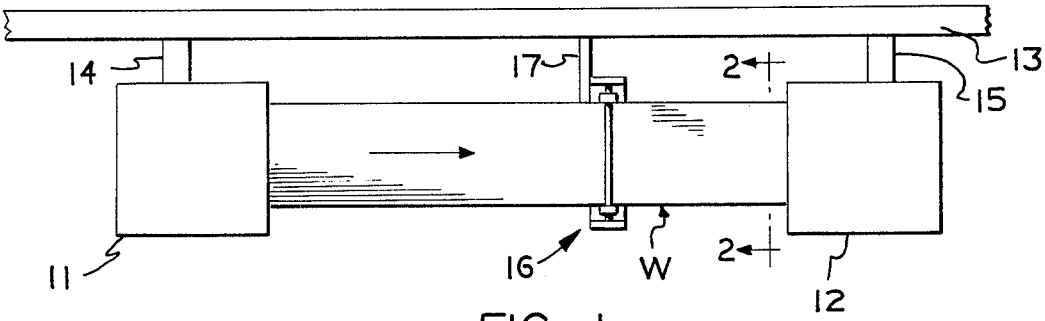
FIG. 1 is a plan view of apparatus incorporating a preferred embodiment of a device in accordance with the present invention.

FIG. 1 illustrates apparatus for processing a web W of a thin sheetlike material such as paper, plastic, metal or the like. Web W may be considered to move on a relatively continuous basis from a first mechanical device 11, shown schematically, to a second mechanical device 12, also shown schematically. Devices 11 and 12 are shown as being attached to a common apparatus frame 13 by means of structural elements 14 and 15, respectively. For purposes of illustration, the apparatus in question may be considered to be a machine for fabricating nestable drinking cups on a high-speed continuous basis from expanded polystyrene, device 11 may be considered to be an unwind stand from which web W is dispensed by unwinding a roll or coil of such material, and device 12 may be considered to be a mechanical splicer for splicing the leading end of a web to be dispensed from another unwind stand (not shown) to the trailing end of the web from device 11, thereby to avoid the need to discontinue the cup production operation when a coil has been exhausted. The path of travel of web W from device 11 to device 12 is shown as being in a horizontal plane, but other arrangements are also contemplated.

For proper operation of a device such as a mechanical splicer it is important that the web entering such device be properly centered along its intended path of travel from an upstream device. In accordance with the present invention, this result is obtained by means of a self-centering device, shown generally at 16, which is attached to frame 13 by means of structural element 17 and which is interposed between device 11 and device 12 along the path of travel of web W therebetween.

Figure 2:
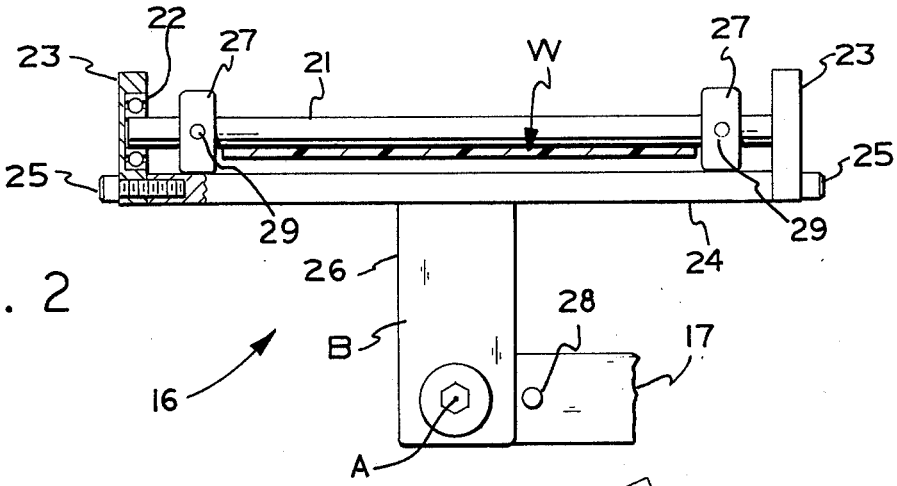
FIG. 2 is an elevational view, at an enlarged scale, taken on line 2—2 of FIg. 1, with portions of the apparatus being broken away to better illustrate certain details of the invention.

As is shown in more detail in FIG. 2, device 16 comprises an elongate double-ended roller 21 which extends transversely across the path of travel of web W and which rotatingly contacts one side of the web, shown as the upper side. The opposed ends of roller 21 are journalled in roller bearings, one of which, bearing 22, is shown in the drawing. Such bearings are retained in horizontally spaced-apart, vertically extending plates 23 which are attached to a common horizontally extending plate 24 by threaded fasteners 25. Plate 24 is located on the underside of web W and is attached to a vertically extending member 26 which in turn is pivotally attached to structural element 17 along an axis A which extends generally parallel to the path of travel of web W from device 11 to device 12. Such axis is preferably located in a plane which extends perpendicularly through the plane of the intended path of travel of the web and in which the intended center of the path of travel is also located. Because of the pivotal nature of the attachment of member 26 to structural element 17, the structure comprising roller 21 and the elements by which it is attached to member 26 functions as a bracket B which may pivot through limited clockwise and counterclockwise arcs about the axis of attachemnt of member 26 to structural element in a plane extending through the path of travel of web W.

Figure 3:
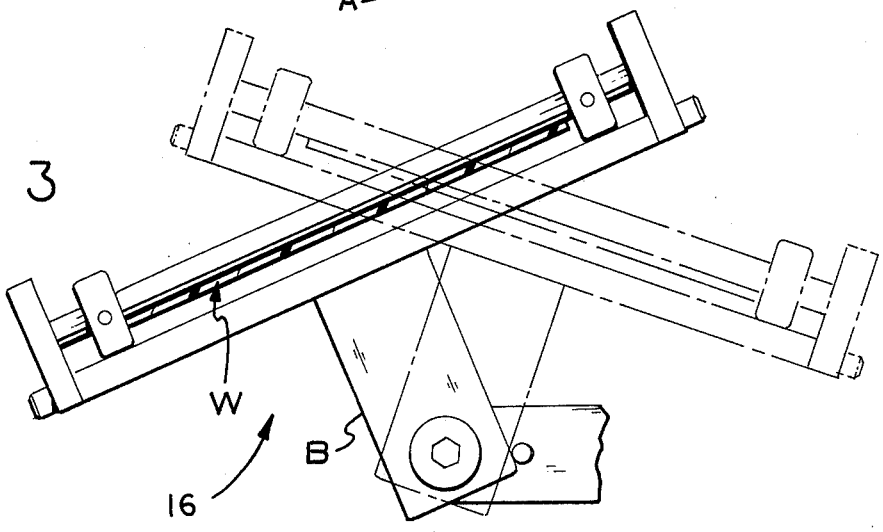
FIG. 3 is a view similar to FIG. 2 showing, in solid line and phantom line, extreme positions of certain elements of the invention which are moveable relative to other elements.

The pivoting movement of bracket B may be actuated by contact with one or the other of the edges of web W with the adjacent of the raised guides 27, as the center of the web drifts to one side or the other of the center of its intended path of travel, such raised guides being spaced apart along roller 21 by a distance which is slightly greater that the web W being processed and which is centered along the intended path of travel of the web. Contact of web W with the raised guide 27 shown at the left of FIG. 2 will cause the bracket B to turn through a limited arc in a counterclockwise direction as is shown in solid line in FIG. 3, such turning being limited in extent by a fixed stop 28 attached to structural element. Such turning action will create an imbalanced force load on the web which will tend to draw its center back to the center of its intended path of travel. Similarly, when the edge of web W contacts the raised guide 27 shown at the right of FIG. 2, bracket B will turn through a limited arc in a clockwise direction, as is shown in phantom line in FIG. 3, thereby creating an imbalanced force load on the web which will to draw it to the left. To permit device 16 to be used in the processing of webs of varying widths, raised guides may be adjustably secured to roller 21 by threaded fasteners 29.

In the embodiment of the invention described, plate 24 should be located very near the raised guides 27, it only being necessary to provide a small spacing therebetween to permit noncontacting rotational movement of raised guides 27, with roller 21 to which they are attached, relative to the plate 24. Such placement of the plate, on the side of the web W opposite from that connected by roller 21, and closer to the axis of rotation of bracket B will confine the path of travel of the web to the slotlike space defined by the roller and the raised guides. In operation of self-centering devices of the type described, it has been noted that the rate of correction of a device of the type described is dependent on the spacing of the axis of rotation of the bracket relative to the path of travel of the web. The rate of correction has been found to be slower for a greater web to axis spacing and faster for a lesser web to axis spacing.

The best mode known to me to carry out this invention has been described above in terms sufficiently full, clear, concise and exact as to enable any person skilled in the art to make and use the same. It is to be understood, however, that it is within my comtemplation that certain modifications of the above-described mode or practicing the invention can be made by a skilled artisan without departing from the scope of the invention and it is, therefore, desired to limit the invention only in accordance with the appended claims.

I claim:

1. A self-centering device for centering a moving web of thin sheetlike material along its intended path of travel, said device comprising in combination: a roller extending transversely across the path of travel of the web; a bracket rotatingly supporting said roller in rotating contact with one surface of the web, said bracket being pivotally mounted on an axis which extends parallel to the path of travel of the web and which is spaced from the moving web, closer to the surface of the web which is not contacted by the roller than to the surface which is contacted by the roller; and a pair of raised guides attached to the roller at spaced apart locations adjacent the opposed edges of the web when the web is moving along its intended path of travel, each of said guides being positioned to contact the adjacent of the edges of the web when the web drifts from its intended path of travel of said web toward said guide, whereby the bracket and the roller pivot about said axis in a plane extending transversely of the path of travel of the web thereby establishing an imbalanced force load on the web which will tend to draw the web back to its intended path of travel.

2. A device according to claim 1 wherein said axis is located in a plane which extends perpendicularly through the plane of the intended path of travel of the web and in which the intended center of the path of travel of the web is also located.

3. A device according to claim 1 wherein said bracket also comprises means spaced from the web between the web and said axis and extending across the web, said means being out of contact with the raised guides but spaced closely thereto to thereby confine the path of travel of the web to a slotlike space defined by the roller and the raised guides.

* * * * *